US006984035B2

(12) United States Patent
Anagnostopoulos et al.

(10) Patent No.: US 6,984,035 B2
(45) **Date of Patent: *Jan. 10, 2006**

(54) RECEIVER MEDIA FOR HIGH QUALITY INK JET PRINTING

(75) Inventors: Constantine N. Anagnostopoulos, Mendon, NY (US); Ravi Sharma, Fairport, NY (US); Mridula Nair, Penfield, NY (US); Kevin M. O'Connor, Webster, NY (US); Michael P. Ewin, Rochester, NY (US); Rukmini B. Lobo, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/915,925

(22) Filed: Aug. 11, 2004

(65) Prior Publication Data

US 2005/0007434 A1 Jan. 13, 2005

Related U.S. Application Data

(63) Continuation of application No. 10/045,686, filed on Oct. 29, 2001, now abandoned.

(51) Int. Cl.
*B41J 2/01* (2006.01)

(52) U.S. Cl. ..... 347/105; 347/101; 428/32.1

(58) Field of Classification Search ..... 347/101, 347/105, 100; 428/32.1, 195, 32.24
See application file for complete search history.

(56) References Cited

U.S. PATENT DOCUMENTS

| | | | |
|---|---|---|---|
| 6,045,917 | A | 4/2000 | Missell et al. |
| 6,197,482 | B1 | 3/2001 | Lobo et al. |
| 6,638,693 | B2 * | 10/2003 | Anagnostopoulos et al. |

FOREIGN PATENT DOCUMENTS

| | | |
|---|---|---|
| WO | 99/55537 | 11/1999 |
| WO | WO 99/55537 | * 11/1999 |
| WO | WO 00/73082 | * 12/2000 |

OTHER PUBLICATIONS

Kenzo Kasahara, "A New Quick-Drying, High-Water-Resistant Glossy Ink Jet Paper," Proceedings IS&Ts NIP 14: 1998 International Conference on Digital Printing Technologies, Toronto, Canada, Oct. 18-23, 1998, pp. 150-152.
Aidan Lavery, "Photomedia for Ink Jet Printing," Proceedings IS&Ts NIP 16: 2000, International Conference on Digital Printing Technologies, Vancouver Canada, Oct. 16-20, 2000, pp.216-220.
Dieter Reichel and Willy Heinzelmann, "Anisotropic Porous Substrates for High Resolution Digital Images," Proceeding IS&Ts NIP 16: 2000 International Confernce on Digital Printing Technologies, Vancouver Canada, Oct. 16-20, 2000, pp. 204-207.

* cited by examiner

*Primary Examiner*—Manish S. Shah
(74) *Attorney, Agent, or Firm*—Arthur E. Kluegel

(57) ABSTRACT

Disclosed is a process for imaging a media for receiving jetted ink, including a support, coated with a hydrophobic film, bearing a predetermined array of three dimensional cells composed of hydrophobic walls and a hydrophilic base, the cell walls being composed of a material that fused subsequent to printing to provide an overcoat layer.

27 Claims, 7 Drawing Sheets

RECEIVER MEDIA FOR HIGH QUALITY INK JET PRINTING

CROSS-REFERENCE TO RELATED APPLICATIONS

This application is a continuation of U.S. application Ser. No. 10/045,686 filed Oct. 29, 2001, the contents of which are incorporated herein by reference. This application is hereby cross-referenced to commonly assigned applications U.S. Ser. No. 10/039,441 published as 2003/082,351 (now abandoned) which is directed to an ink jet colorant imaging media containing small cells and U.S. Ser. No. 10/046,024, now U.S. Pat. No. 6,638,693 which is directed to a method of forming a cellular ink jet media.

FIELD OF THE INVENTION

This invention relates to processing a media for receiving jetted ink comprising a support bearing a predetermined array of three dimensional cells composed of hydrophobic walls and having a hydrophilic base, the cells being composed of a material that is fused subsequent to printing to provide an overcoat layer for the printed image.

BACKGROUND OF THE INVENTION

Prints made using an ink-jet printer desirably have image resolution of about 6 line pairs/mm, which corresponds to about 84 $\mu$m per line or equivalently about 300 dots per inch. They must have a dynamic range of about 128 color density gradations (or levels of gray) or more in order to be comparable in image quality to conventional photographic prints.

Secondary colors are formed as combinations of primary colors. The subtractive primary colors are cyan, magenta and yellow and the secondary ones are red, green and blue. Gray can be produced by equal amounts of cyan magenta and yellow, but less fluid is deposited on the paper if the gray is produced from an ink supply containing only black dye or pigment.

Typically, a print head emits 4 pL droplets. The 4 pL droplet has a diameter of about 20 $\mu$m in the air and forms a disk of about 30 $\mu$m on the paper. Adjacent droplets are typically aimed to be placed on 21 $\mu$m centers so that adjacent disks on the paper have some overlap and thus ensure that full area coverage is obtained and that the misdirection of a jet does not produce visible artifacts. Then, as taught in U.S. Pat. No. 6,089,692 of Anagnostopoulos, if a saturated spot of a secondary color is to be formed, at least 256 droplets (128 of each of the primary colors) have to be deposited per 84×84 $\mu$m area. The amount of fluid deposited per unit area is then about 145 mL/m$^2$.

There are a large number of commercial ink-jet papers. Two of the most successful are described briefly here. The first is shown in FIG. 1. The receiver, as described in U.S. Pat. No. 6,045,917 of Missell et al., consists of a plain paper base covered by a polyethylene coat. This coat prevents any fluid, especially water from the ink, from penetrating into the paper base and causing puckering or wrinkling termed "cockle". The front side of the paper is additionally coated with two layers of polymers containing mordant. The polymer layers absorb the ink by swelling while the dyes are immobilized in the mordant. An anti-curl layer is also coated in the backsides of this paper.

The second commercial paper is described by Kenzo Kasahara, in "A New Quick-Drying, High-Water Resistant Glossy Ink Jet paper," Proceedings IS&T's NIP 14: 1998 International Conference on Digital printing Technologies, Toronto, Canada, Oct. 18–23, 1998, pp 150–152, and is shown in FIG. 2. Like the first paper, the paper base is coated with a polyethylene film to prevent cockle. The image-receiving layer consists of three separate layers. Each one is made up of ICOS (inorganic core/organic shell) particles in a polyvinyl alcohol binder and boric acid hardener, forming a micro-porous structure. The porosity of all three layers combined is about 25 ml/m$^2$. Each of the ICOS particles, of the order of 0.05 $\mu$m in diameter, consists of an anionic silica core surrounded by a cationic polymer shell.

Inkjet print heads have been recently invented that are page wide and have nozzle spacing of finer than 300 per inch. See, for example, U.S. Pat. No. 6,079,821, of Chwalek et al. Such print heads produce 1 to 2 pL droplets which are smaller than the typical droplets produced by the commercial print heads. Also, because they are page wide and have a large number of nozzles, they are capable of ink lay down rates substantially higher than that of the scanning type conventional ink-jet printers.

Significant problems stem from the jetting of dye or pigmented inks onto a media. In many cases a different level of gloss is required so that it is necessary to modify the finish of the media. It is also common that the quality of the image degrades with exposure to ambient air, water, abrasion, and UV components in light. A need therefore exists for a type of image receiver media that is capable of providing a modified finish and/or a protective overcoat layer for the printed image.

SUMMARY OF THE INVENTION

The invention provides a media for receiving jetted ink, comprising a support bearing a predetermined array of three dimensional cells composed of hydrophobic cell walls and having a hydrophilic base, the cell walls being composed of a material capable of being fused subsequent to printing to provide an overcoat layer. The media of the invention provides an image receiver media that is capable of providing a modified finish and/or a protective overcoat layer for the printed image.

The invention also provides a process for forming an image on the media of the invention and for forming a finish-modifying and/or protective coating over such an image.

DETAILED DESCRIPTION OF THE INVENTION

Figure 1:
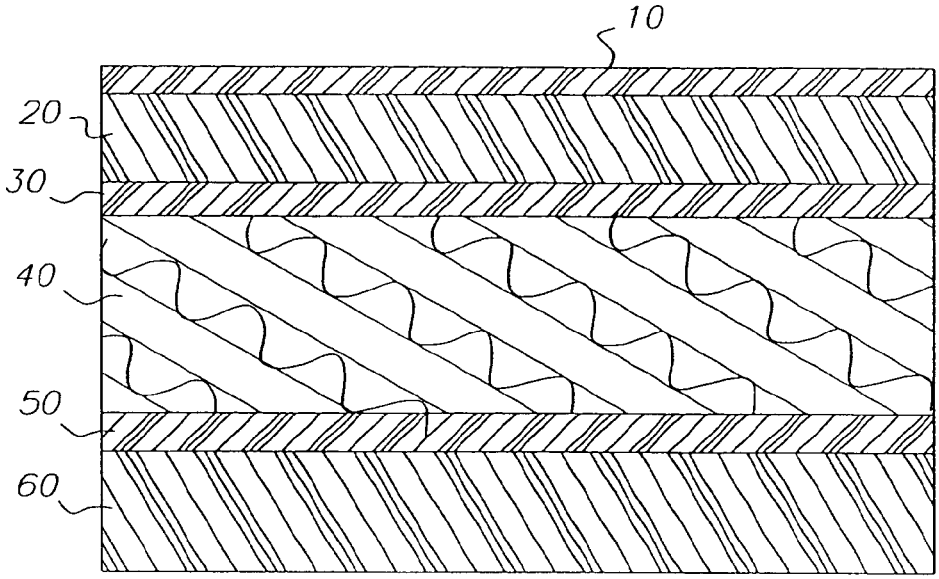
(PRIOR ART) FIG. 1
FIGS. 1 and 2 are schematic examples showing cross sectional views of two conventional ink-jet media of the prior art.

The media of the present invention is different from conventional media in that it does not depend on ink diffusion or absorption by capillary action to avoid coalescence and color bleed. Instead the surface of the receiver is covered with a predetermined array of regular shaped reservoirs or cells that hold the fluid and keep it from communicating with adjacent drops. Such a cell array is shown in FIG. 3 and is formed on top of the conventional ink-jet paper shown in FIG. 1. The term bonded is employed herein to generically indicate that successive layers or deposits form an integral structure, with or without an adhesion promoting material. FIG. 1 shows a prior art ink-jet media comprising a paper support 40 separated from backside anti-curl layer 60 by polyethylene resin film 50. The paper support is coated with polyethylene film 30, bottom swellable polymer containing mordant 20 and top swellable polymer containing mordant 10. The polyethylene film 30 prevents the ink carrier fluid from entering the paper.

Figure 2:
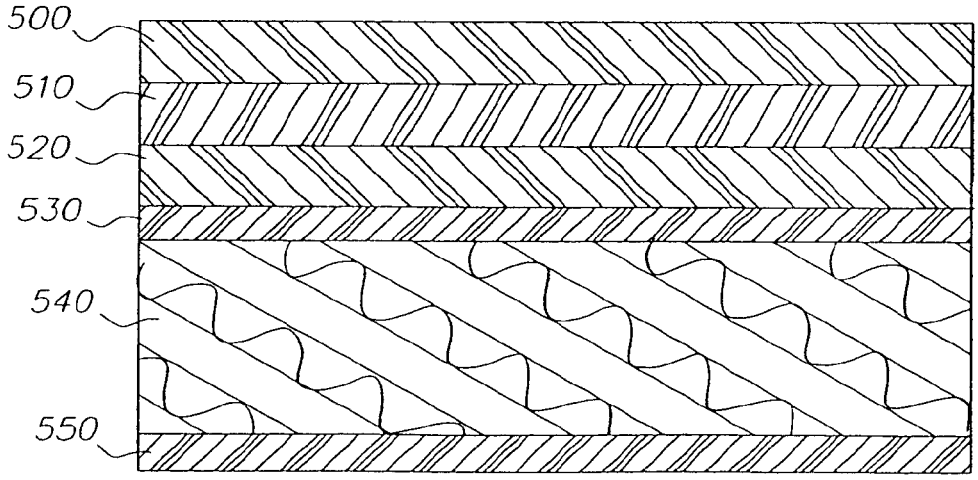
(PRIOR ART) FIG. 2

FIG. 2 shows a similar prior art media to FIG. 1, comprised of polyethylene layers 550 and 530 sandwiched about paper support 540 and bearing image receiving layers 500, 510, and 520.

Figure 3A:
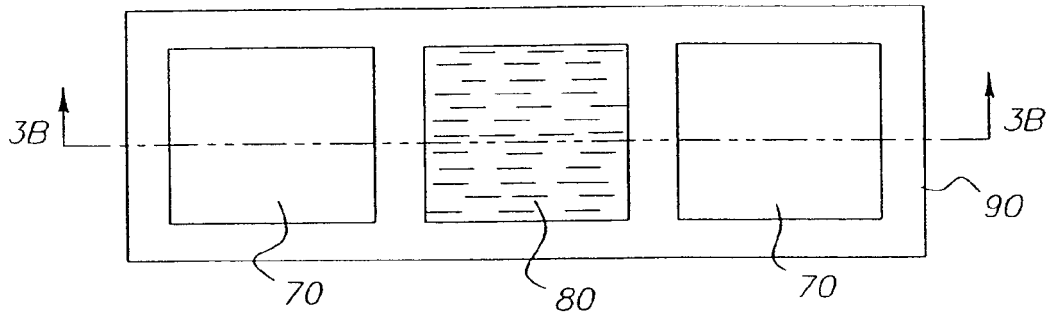
FIGS. 3*a*/3*b* and 4*a*/4*b* are plan and cross sectional views of two different embodiments of portions of ink-jet media of the invention.
Figure 3B:
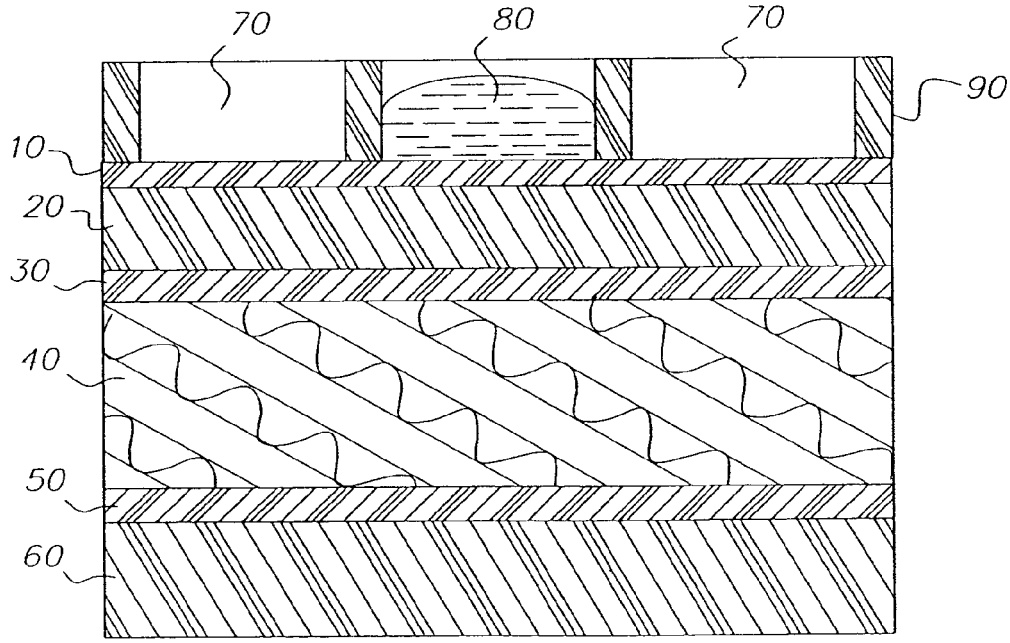

FIGS. 3*a* and 3*b* show the inventive embodiment derived from FIG. 1 in which the hydrophobic cell walls 90 of the cells 70, are supported on the swellable polymer 10. Recently deposited ink droplet 80 is contained in the cell.

Figure 4A:
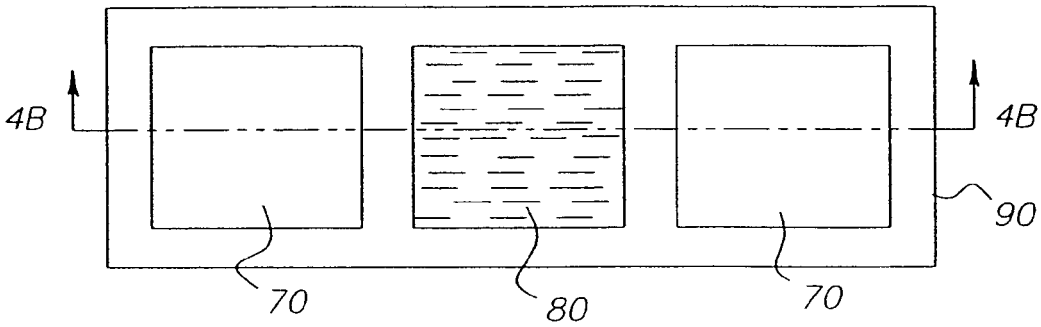
Figure 4B:
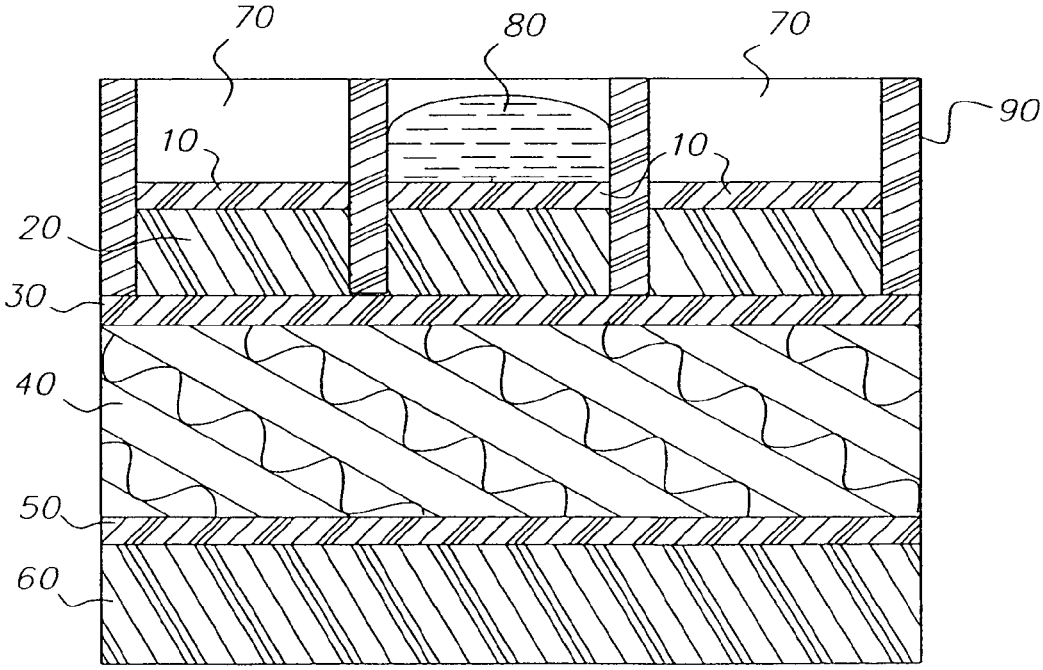

An alternative architecture is shown in FIGS. 4*a* and 4*b* where the cell array is built on top of the polyethylene coat, and then the image-receiving or colorant holding layer is deposited on the base of each cell. These figures show the inventive embodiment derived from FIG. 1 in which the hydrophobic cell walls 90 of the cells 70 are bonded to the polyethylene layer 30 and the swellable polymers 10 and 20 are located on the cell base.

Figure 5:
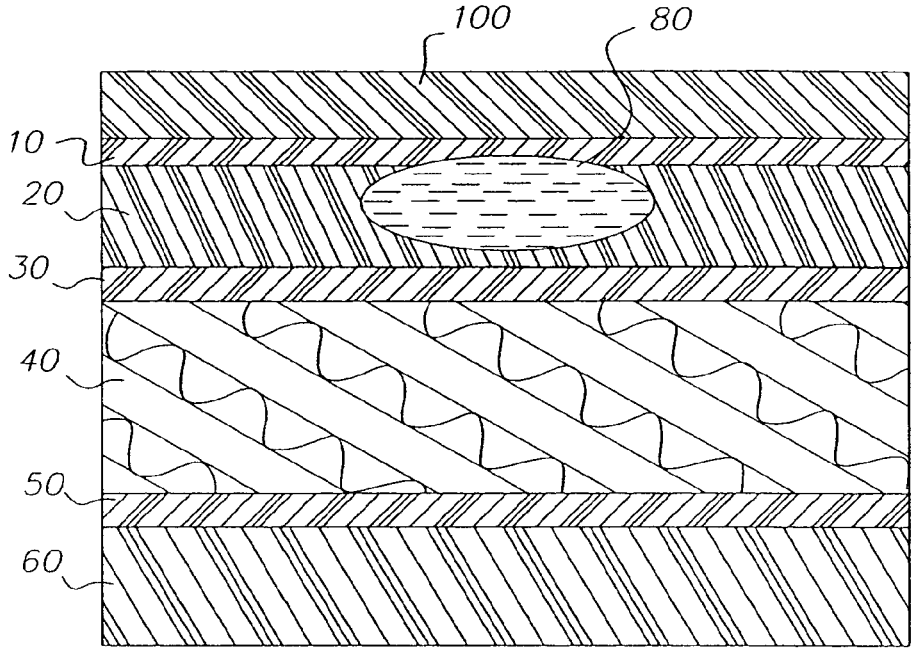
FIGS. 5 and 6 are cross sectional views of the embodiments of FIGS. 3 and 4 after fusing of the cell wall structure.
Figure 6:
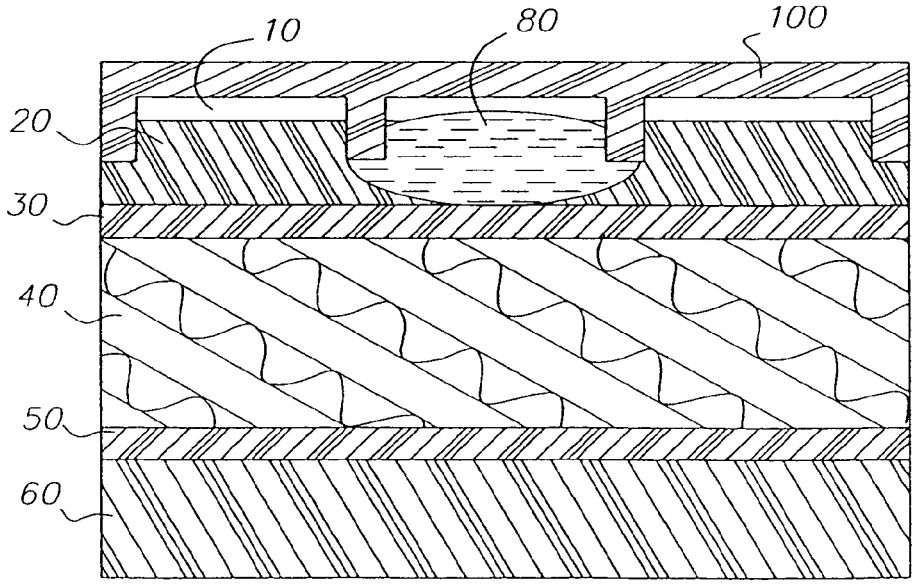

FIG. 5 shows the schematic cross section of FIG. 3 after fusing in which the hydrophobic walls have been converted to a protective layer 100 and ink droplet 80 has spread out during absorption. FIG. 6 shows the schematic cross section of FIG. 4 after fusing in which the hydrophobic walls have been converted to a protective layer 100.

In operation, the cells receive the ink from the print head and by the end of the printing cycle much of the ink still remains confined in the cells. The receiver is then moved to a holding area and kept there until most of the volatile portion of the ink evaporates. Because of the cell structure, the paper sheets can be stacked one on top of each other since the cell walls can serve as standoffs. If the cells are left standing, they will produce a structured or matte surface appearance because of the light scattering off the cell walls. If a glossy finish is desired, then the media may, after application of the ink, be subjected to elevated temperature and/or pressure e.g. via a heated roller that melts or fuses the walls of the cells. This process gives the image a glossy finish and forms a continuous protective overcoat film, shown schematically in FIGS. 5 and 6, similar to what lamination accomplishes. As a further advantage, this overcoat protects the image from water, airborne pollutants and abrasion damage and can offer UV and/or other protection for long colorant stability and image life. In FIG. 6, the portions of the cell walls adjacent to the image-receiving layer are shown broken. This occurs during melting to allow colorant diffusion sideways for better image quality. Care should be taken to prevent the cell material from sinking into the softened image-receiving layer below it. This can be accomplished by making the image-receiving layer stiffer such as by cross-linking of the gel or by other means. Also, the sub-pixels shown in FIG. 6 may have shapes other than squares, such as rhombus, hexagonal, or diamond shaped, for easier wall collapse under the application of heat and pressure.

Figure 7:
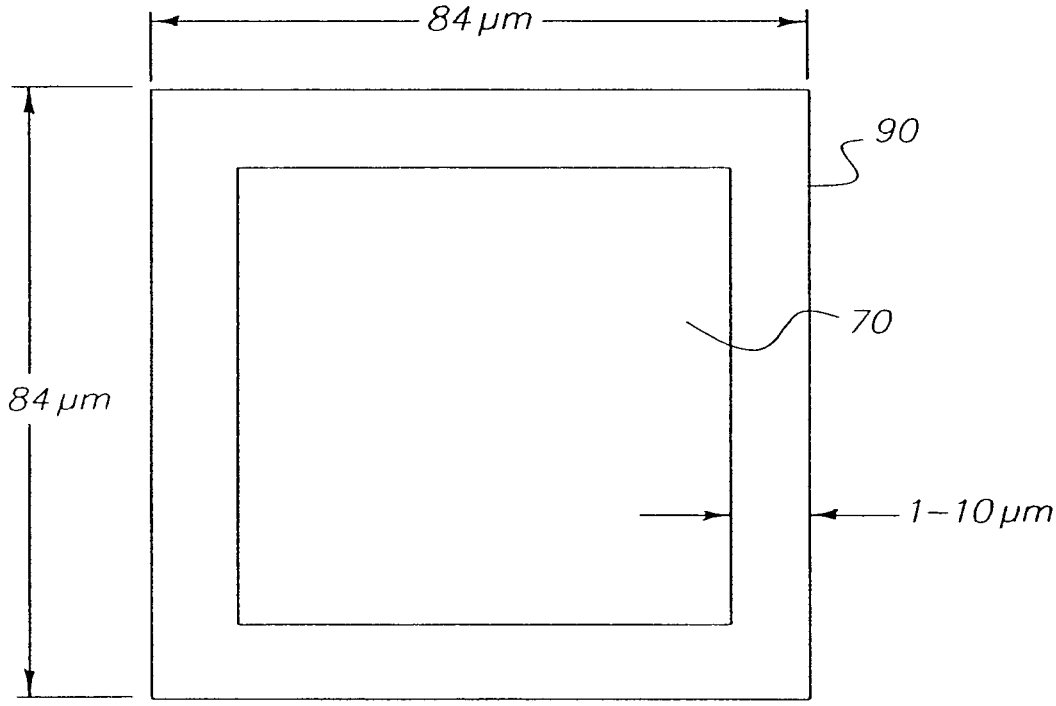
FIG. 7 is a schematic showing the plan view of an 84×84 $\mu$m cell useful in the invention.
Figure 8A:
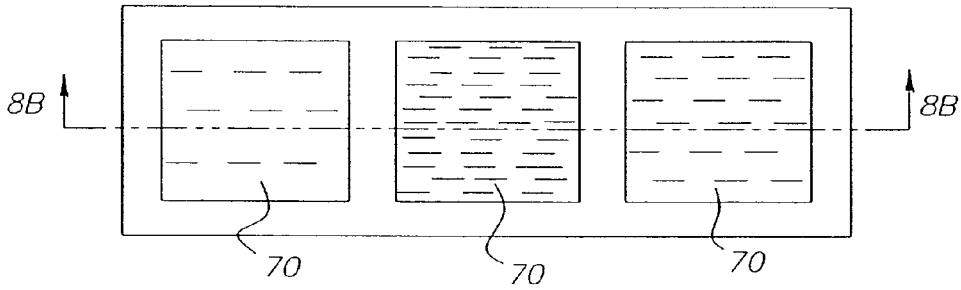
FIGS. 8*a* and 8*b* are respectively a plan view and a front sectional view of one cell arrangement useful in the invention.
Figure 8B:
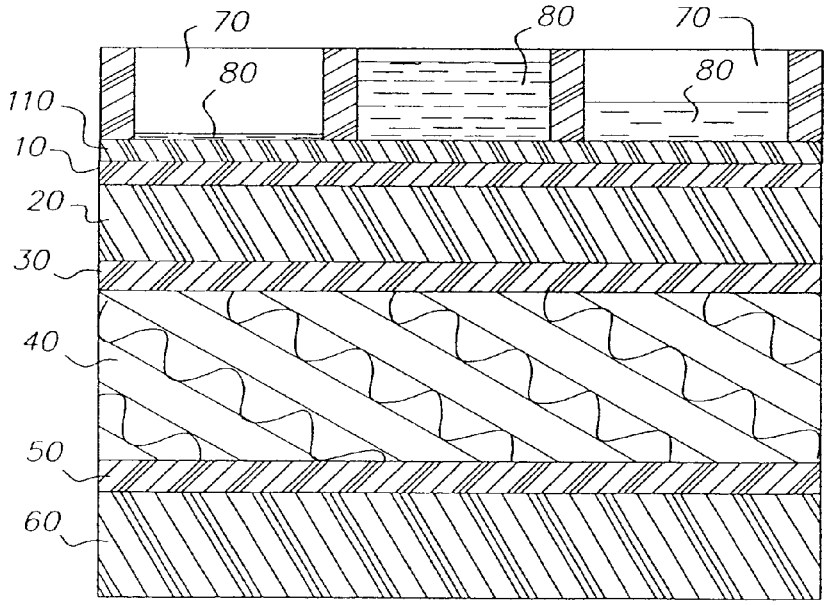
Figure 9A:
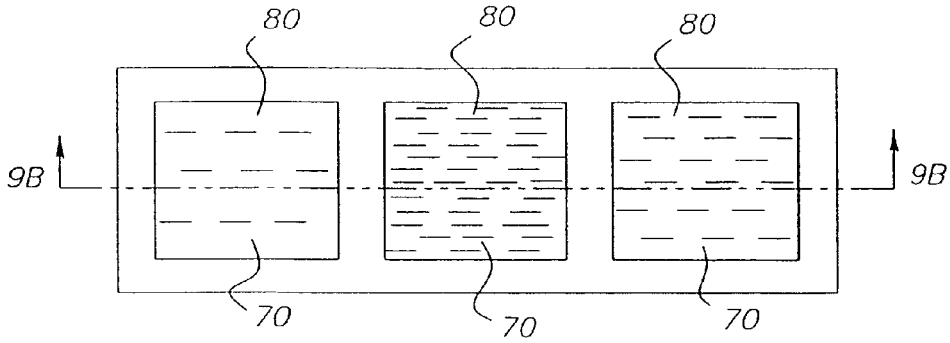
FIGS. 9*a* and 9*b* are respectively a plan view and a front sectional view of an alternate cell arrangement useful in the invention.
Figure 9B:
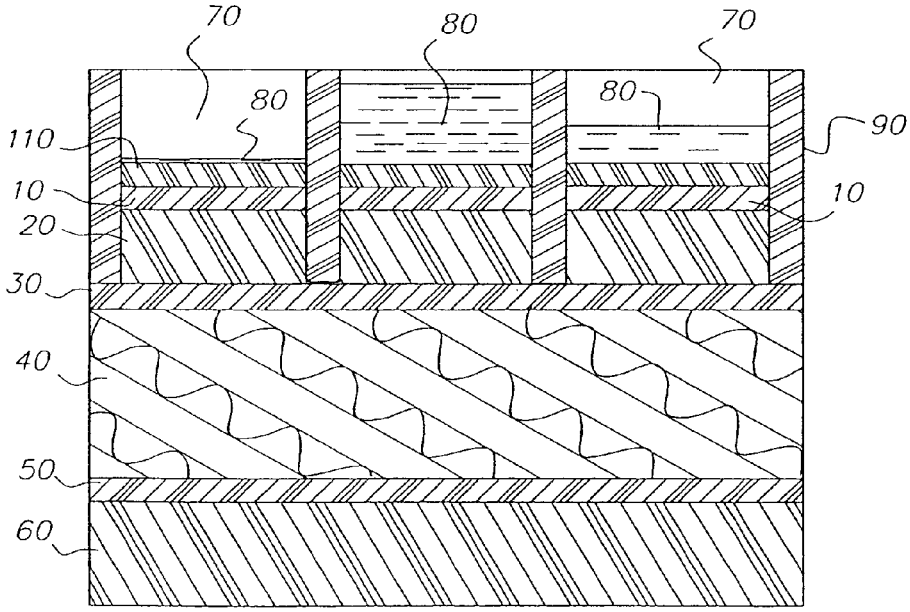

Alternatively, the subpixels may be eliminated and the cell thus comprises the entire pixel, as shown in FIG. 7. The cells must then have a fluid holding capacity of 128 pL per pixel for a saturated primary color spot and 256 pL for a secondary color spot. Assuming 2 $\mu$m thick walls, the wall heights have to be about 20 and 40 $\mu$m respectively. For these large area cells, attention should be given to the requirement that when the walls are melted at the end of the printing step they provide about a 2 $\mu$m thick protective film over each pixel on the paper. This condition is met for walls that are at least 20 $\mu$m high.

To avoid possible Moiré pattern formations, for both the small and large area cells it may be advantageous to place them on the paper not in a regular grid arrangement, but in a random or pseudo-random pattern.

One problem with the large area cells is that if only a few droplets are deposited in a pixel, as will be the case for low-density image areas, then grain or noise will appear, because the small amount of fluid deposited will not be enough to cover the base of the cell. One way to solve this problem is to have a hydrophilic slow-absorbing layer 110 in the base of the cells. This layer will then cause even a single drop to spread throughout the cell area prior to absorption as is demonstrated in FIGS. 8A, 8B and 9A and 9B, thus reducing grain.

A possible advantage of having the cell array on the receivers and depositing the various color inks in them simultaneously, that is long before a substantial absorption into the image receiving layer occurs, is that the various colorant will have time to mix thus producing truer color. Another advantage, particularly with the larger cells is that any minor misdirection of the droplets will be corrected so long as the misdirection is less than ½ the cell side.

The desired cell array, area, and volume depend on the desired final image quality. If the newest print head technology produces 1 pL drops, the drops are about 12 $\mu$m diameter spheres when in the air and produce an image of a circular disc on conventional ink jet papers of a diameter about 50% larger than their diameter in air. The increase depends on the drop velocity, how hydrophilic the surface is, and the rate of absorption of the fluid into the paper. It is assumed further that the colorant concentration in these drops is at the maximum value, that is, the disc formed on the paper results in an image that has maximum color saturation. For a secondary color, as discussed previously, two droplets are needed per site. The smallest spot size visible by the human eye is about 84×84 $\mu m^2$. Since a 1 pL droplet produces an image on the paper of about 18 $\mu$m in diameter, then the pixel could be subdivided into an array of 5×5 sub-pixels, each about 17 $\mu$m in diameter.

Without any sub-pixel cell boundaries, as in the conventional papers, this would allow for substantial overlap of adjacent droplets as is desirable for full area coverage. Because the pixel is subdivided into 25 subpixels, a dynamic range or color density gradations of 26 is thus possible for each pixel. One way of preventing coalescence and color bleed, in this lower image quality paper, is to create a ring pattern on the surface of the conventional ink jet paper consisting of a transparent hydrophobic film.

The line widths of the hydrophobic cells may vary from 1 to 10 $\mu$m and their height can vary from <<1 $\mu$m to >>1

μm. However, since no ink stays on top of the hydrophobic areas, for full colorant area coverage, the ink will desirably diffuse under them from the adjacent hydrophilic regions. If the height of the hydrophobic cell walls are too short, the cells cannot be melted in order to modify the finish or provide the desire protective overcoat layer.

One disadvantage of using full colorant concentrated inks is that in the low density areas of an image, where droplets are placed far apart, the image looks grainy or noisy in those locations. This is the reason many commercial ink jet printers have two extra ink supplies one of low colorant density cyan color and one low colorant density magenta color.

To obtain a higher image quality, the sub-pixels must be able to contain more than one or two droplets of ink. This is accomplished by increasing the heights of the sub-pixel walls thus increasing their volume or ink holding capacity. Note that, as disclosed in U.S. Pat. No. 6,089,692 of Anagnostopoulos, the colorant concentration in the ink must now be ⅛ the saturation value. That is, it takes 8 droplets one on top of another of one primary color to achieve a fully saturated spot of that color on the paper. For a secondary color 16 droplets are required, 8 of each primary color. The advantages of the diluted ink are higher dynamic range within a single pixel and, in the low-density areas of a print, less grain or noise without the need for extra supplies of low colorant density inks. Excess dynamic range can be used for banding and other artifact correction or other image quality enhancements.

The protective ingredients suitable for inclusion in the cell wall materials useful in the invention are not limited. Examples include those that function to protect the image form adverse effects due, for example to UV, moisture, ambient air, and abrasion. Such components are well-described, for example, Kirk-Othmer's Encyclopedia of Chemical Technology. Typical examples of UV absorbers include derivatives of triazoles, triazines, hindered amines, and phenones.

There are a number of ways to make the cells and a variety of materials that meet the requirements. In one method the cells are made on top of the currently commercial ink jet papers, such as shown in FIG. 1 or 2. The process starts with inkjet paper onto which is coated, by wet roll or curtain coating, a thin layer of sol-gel (which may be an aqueous solution of a silica chemical species or metal alkoxides and water in an alcoholic solvent) and then drying of this coat at near room temperature. The resulting dried film, called xerogel, is transparent and has the important property that it is not etched by oxygen plasma. Then a thick layer of a plastic film is coated, which eventually will form the cell walls. The properties of this film are that it forms a scratch resistant film after it cools, that it is impenetrable to water, pollutants and oils and that it can be doped with UV absorbing colorants. Another thin layer of sol-gel is then coated on top of the plastic layer followed by a coating of photoresist. This photoresist film is then exposed through a mask and developed forming the desired cell pattern. For the purpose of high productivity and low cost, and to obviate problems arising from the internal stresses of the various films, it is best to utilize a web-based process for all these steps. Now, with the photoresist as the mask, the top xerogel layer is etched selectively in a plasma environment containing active fluoride ions that react with the Silicon in the xerogel matrix forming volatile $SiF_4$ molecules, thus removing the layer. The paper is subjected next to another plasma environment this one containing oxygen ions. This process removes the plastic film in the desired cell areas and the remaining photoresist but does not affect the top xerogel layer, thus protecting the top of the cell walls. Then the fluoride ion plasma etch process is repeated to remove the xerogel film on the top of the cell walls as well as the xerogel film at the base of the cells.

Suitable cell wall materials are hydrophobic polymers that are generally classified as either condensation polymers or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl esters, vinyl heterocyclic compounds, styrenes, olefins and halogenated olefins, unsaturated acids and esters derived from them, unsaturated nitrites, vinyl alcohols, acrylamides and methacrylamides, vinyl ketones, multifunctional monomers, or copolymers formed from various combinations of these monomers. Preferred polymers may also comprise monomers which give hydrophilic homopolymers, if the overall polymer composition is sufficiently hydrophobic to channel the aqueous ink to the hydrophilic cell base. Further listings: of suitable monomers for addition type polymers are found in U.S. Pat. No. 5,594,047 incorporated herein by reference.

In the embodiment as described in FIG. 3 where the image receiving layers are only in the base of the cells, then the cells are built on top of the polyethylene film that coats the paper base, in exactly the same way as described above. Then at the end of that process, the image receiving layers are coated over the cells and are allowed to settle into the bottom of the cells.

Other methods of fabricating the cells are by embossing, as taught, for example, in U.S. Pat. No. 4,307,165; stamping, as discussed, for example, in the article entitled "Flexible Methods for Microfluidics" by George M. Whitesides and Abraham D. Stroock in the June 2001 Issue of Physics Today or gravure printing as taught is U.S. Pat. No. 6,197,482 or screen printing.

With the foregoing embodiments, it is also possible not only to satisfy the ink handling requirements, but also to meet the criteria for photographic quality prints with as few as four inks per print head for low cost and fast printing times.

The entire contents of the patents and other publications referred to in this specification are incorporated herein by reference.

PARTS LIST

10 Top swellable polymer containing mordant
20 Bottom swellable polymer containing mordant
30 Polyethylene or other hydrophobic film
40 Paper support or other hydrophilic support
50 Polyethylene or other hydrophobic film
60 Backside anti-curl layer
70 Cells
80 Ink
82 First color ink
84 Second color ink
90 Hydrophobic cell walls
100 Protective layer
110 Hydrophilic slow-absorbing layer
500 Image receiving layer
510 Second image receiving layer
520 Third image receiving layer
530 Polyethylene layer

540 Paper support
550 Polyethylene layer
600 Hydrophilic ink absorbing area
610 Hydrophobic walls

What is claimed is:

1. A process for forming an image, comprising:

imagewise jetting an ink onto an image receiving media for receiving jetted ink, comprising a support, coated with a hydrophobic film, bearing a predetermined array of three dimensional cells composed of hydrophobic walls and a hydrophilic base, the cell walls being composed of a material capable of being fused subsequent to printing to provide an overcoat layer, the cell walls being supported by either a hydrophilic base film or the hydrophobic film that is coated onto the support, and thereafter fusing the cell walls of the media so they flow over and protect the image while the hydrophilic or hydrophobic film supporting the walls remain stiff so the walls do not sink into the wall supporting hydrophilic or hydrophobic films.

2. The process of claim 1 wherein the fusing is accomplished by heating the image receiving media to a temperature of 100° C. or less, whereby the cell walls are melted but the wall supporting hydrophilic or hydrophobic film remains stiff.

3. The process of claim 2 wherein the heating is accomplished by radiation.

4. The process of claim 2 wherein the heating is accomplished by induction.

5. The process of claim 1 wherein the fusing is accomplished using a means other than heating.

6. The process of claim 1 wherein the fusing is accomplished by the application of a solvating fluid to the cell walls.

7. The process of claim 1 wherein the predetermined array is a regular pattern.

8. The process of claim 1 wherein the predetermined array is not a regular pattern.

9. The process of claim 1 wherein the plan cross section of the cells parallel to the support is circular.

10. The process of claim 1 wherein the plan cross section of the cells parallel to the support is one leaving substantially no space between cells.

11. The process of claim 1 wherein the plan cross section of the cells parallel to the support is rectangular, square, hexagonal, or rhomboidal.

12. The process of claim 1 in which the cell walls rest on a hydrophilic layer.

13. The process of claim 1 in which the cell walls rest on a hydrophobic layer.

14. The process of claim 13 wherein the hydrophilic base of the cell is bonded to the hydrophobic layer.

15. The process of claim 1 wherein the hydrophobic walls contain a UV absorber.

16. The process of claim 15 wherein the UV absorber is a hindered amine derivative.

17. The process of claim 15 wherein the UV absorber is a triazole derivative.

18. The process of claim 15 wherein the UV absorber is a phenone derivative.

19. The process of claim 1 wherein the hydrophobic walls contain a free radical quencher.

20. The process of claim 1 wherein the hydrophobic walls contain a colorant stabilizer.

21. The process of claim 1 wherein the hydrophobic walls contain a pigment stabilizer.

22. The process of claim 1 wherein the hydrophobic walls contain a dye stabilizer.

23. The process of claim 1 wherein the volume of the cell walls is sufficient to provide, upon fusing, an average overcoat thickness of at least 1 $\mu$m.

24. The process of claim 1 wherein the hydrophobic cell walls comprise a condensation polymer or an addition polymer.

25. The process of claim 1 wherein the cell walls comprise a polymer or copolymer containing polyesters, polyamides, polyurethanes, polyureas, polyethers, polycarbonates, or polyacid anhydrides.

26. The process of claim 1 wherein the cell walls comprise a polymer or copolymer formed from allyl compounds, vinyl ethers, vinyl esters, vinyl heterocyclic compounds, styrenes, olefins and halogenated olefins, unsaturated acids and esters derived from them, unsaturated nitriles, vinyl alcohols, acrylamides and methacrylamides, vinyl ketones, multifunctional monomers, or copolymers formed from combinations of these monomers.

27. The process of claim 1 wherein the media is subjected to elevated temperature and/or pressure sufficient to fuse the walls but not sufficient to melt the cell wall supporting hydrophilic or hydrophobic film.

* * * * *